US008181677B2

(12) United States Patent
Li et al.

(10) Patent No.: US 8,181,677 B2
(45) Date of Patent: May 22, 2012

(54) AUTOMATED DISPENSER FOR RADIOPHARMACEUTICALS

(75) Inventors: Ming-Hsin Li, Taoyuan County (TW); Wuu-Jyh Lin, Taoyuan County (TW); Tain-Shi Zen, Taoyuan County (TW)

(73) Assignee: Institute of Nuclear Energy Research, Jiaan Village, Longtan, Taoyuan (TW)

( * ) Notice: Subject to any disclaimer, the term of this patent is extended or adjusted under 35 U.S.C. 154(b) by 1129 days.

(21) Appl. No.: 11/868,540

(22) Filed: Oct. 8, 2007

(65) Prior Publication Data

US 2009/0108018 A1 Apr. 30, 2009

(51) Int. Cl.
*B67C 3/00* (2006.01)

(52) U.S. Cl. ..... 141/275; 141/21; 141/27; 141/269; 141/283; 141/330

(58) Field of Classification Search ..... 141/2, 18, 141/21, 25, 27, 129, 165, 168, 269, 271, 141/275, 283, 329, 330, 113
See application file for complete search history.

(56) References Cited

U.S. PATENT DOCUMENTS

| | | | | |
|---|---|---|---|---|
| 4,056,096 | A * | 11/1977 | Collica et al. | 600/5 |
| 4,060,073 | A * | 11/1977 | Collica et al. | 600/5 |
| 5,341,854 | A * | 8/1994 | Zezulka et al. | 141/1 |
| 5,431,201 | A * | 7/1995 | Torchia et al. | 141/98 |
| 6,048,086 | A * | 4/2000 | Valerino, Sr. | 706/10 |
| 7,900,658 | B2 * | 3/2011 | Osborne et al. | 141/2 |
| 8,069,886 | B1 * | 12/2011 | Yanke et al. | 141/252 |
| 2006/0151048 | A1 * | 7/2006 | Tochon-Danguy et al. | 141/27 |
| 2009/0038709 | A1 * | 2/2009 | VanVreeland et al. | 141/18 |

* cited by examiner

*Primary Examiner* — Gregory Huson
*Assistant Examiner* — Jason Niesz

(57) ABSTRACT

An automated dispenser for radiopharmaceuticals is mainly for a platform to have a moving mechanism being able to move three-dimensionally back and forth, a syringe holder and a bottle holder. The syringe holder is for holding a plural number of syringes. The bottle holder has a reverse drug bottle. The moving mechanism has a syringe clamp rotatable around a horizontal axis and a syringe driving mechanism. The syringe clamp is activated to hold a syringe and move it to where the syringe needle is inserted to the drug bottle. The syringe driving mechanism and the syringe clamp are simultaneously associated with the syringe for drug-withdrawing action.

8 Claims, 3 Drawing Sheets

AUTOMATED DISPENSER FOR RADIOPHARMACEUTICALS

FIELD OF THE INVENTION

The invention is related to an automated dispenser for radiopharmaceuticals. Especially it refers to a situation that hand contact with radiopharmaceuticals is avoided and exposure to radioactive materials is reduced for operators.

DESCRIPTION OF THE PRIOR ART

Traditional dispenser for radiopharmaceuticals mostly is used for small scale dispensing in laboratory. It is not only inconvenient but also functionally limited. Without continuous operation its dispensing cost is high. So mass production is difficult.

In view of the above shortcomings for traditional dispenser for radiopharmaceuticals, the inventor has strived to improve the dispenser and created the invention.

SUMMARY OF THE INVENTION

Thus the main objective for the invention is to provide an automated dispenser for radiopharmaceuticals, so it automatically dispenses high-dose radiopharmaceuticals from bottles into sterile syringes and reduces direct exposure to radioactive environment for operators.

Another objective for the invention is to provide an automated dispenser for radiopharmaceuticals, so it uses sterile syringes to dispense radionuclides into bottles for chemical reactions or other uses.

Another objective for the invention is to provide an automated dispenser for radiopharmaceuticals, so it is suitable for withdrawing highly toxic and highly contagious pharmaceuticals and demonstrates value of extensive applications.

To achieve the above objectives and functions, the technical approaches include: one platform with at least one supporting plane at top; one drug bottle at one side of the platform; one moving mechanism located on the supporting plane to drive a syringe clamp to hold a syringe and move it in space repeatedly, and rotate around an axis in the parallel direction to make the syringe to move from outside to the position for a needle to insert; a syringe driving mechanism to move simultaneously with the syringe clamp driven by the moving mechanism and to have a driving rod on it to drive the syringe for withdrawing drug.

The moving mechanism is at least composed of an X-axis moving module, a Y-axis moving module and a Z-axis moving module. So the syringe clamp driven by the Z-axis moving module can ascend or descend along the direction perpendicular to Z-axis. The Z-axis moving module which is driven by the Y-axis moving module slides back and forth in the direction of Y-axis in a preset horizontal plane. The Y-axis moving module which is driven by the X-axis moving module slides back and forth in the direction of X-axis in the horizontal plane.

The syringe clamp is associated with the Z-axis moving module through a rotation module. Driven by the rotation module, the syringe clamp rotates against the Z-axis moving module.

The syringe is located inside a lead shield which periphery has a flange in its middle section. The syringe clamp has a groove corresponding to the flange position. Through the shifting of the groove against the flange back and forth, engagement or disengagement can be achieved.

Other objects, advantages and novel features of the invention will become more apparent from the following detailed description when taken in conjunction with the accompanying drawings.

DETAILED DESCRIPTION OF THE PREFERRED EMBODIMENT

Please refer to FIG. 1 and FIG. 2. It is clear that the invention mainly includes: a platform 1, a moving mechanism 2, a syringe driving mechanism 3, a syringe holder 4 and a bottle holder 5. The platform 1 has a supporting plane on top. The moving mechanism 2 is composed of an X-axis moving module 21, a Y-axis moving module 22, a Z-axis moving module 23 and a rotation module 24. The X-axis moving module 21 is located on the supporting plane of the platform 1. A power source 211 (such as a step motor) drives a shifting platform 212 to move along a preset straight track (assuming it is X-axis). The Y-axis moving module 22 is located on the shifting platform 212 and uses a power source 221 (such as a step motor) to drive a shifting platform 222 to move along a straight track perpendicular to X-axis (assuming it is Y-axis). The rotation module 24 is located on the shifting platform 222 and uses a power source 241 to drive a rotation base 242 to turn around the axis parallel to Y-axis. Finally, the Z-axis moving module 23 is located on the rotation base 242 and uses a power source 231 (such as a step motor) to drive a shifting base 232 to move along a straight track (assuming it is Z-axis) perpendicular to X-axis and Y-axis. The shifting base 232 has a syringe clamp 233. The syringe clamp 233 has a clamping slot 234 with an opening. The syringe driving mechanism 3 is associated with the shifting base 232, and uses a power source 31 (such as a step motor) to drive a driving rod 32 to move along a straight track parallel to Z-axis, and makes the driving rod 32 to connect with a moving device 33 which bottom has a clamping slot 34 with an opening. The syringe holder 4 is located at one side of the moving mechanism 2 for accommodating a plural number of syringes 42. The syringes 42 are located inside a lead shield 41. The lead shield 41 has a flange 411 in the middle section of its periphery. At the bottom of the syringe holder 4 there are a plural number of syringe cylinders corresponding to the syringe 42 needles position. So when the syringe 42 is positioned at the syringe holder 4, each cylinder is placed outside the syringe needle. The bottle holder 5 is located one side of the moving mechanism 2 and the syringe holder 4 and mainly used to hold bottles for radiopharmaceuticals. The bottles are placed and fixed in a designated lead box 51 and have their mouth down for the convenience of withdrawing drug.

Please refer to FIG. 2 and FIG. 3. It is known that the moving mechanism 2 through digital system control makes X-axis moving module 21, Y-axis moving module 22 and Z-axis moving module 23 to shift in a proper distance and makes the clamping slot 234 for the syringe clamp 233 to put on the flange 411 of the lead shield 41, while the clamping slot 34 of the syringe driving mechanism 3 can be put on the drug-withdrawing rod of the syringe 42. Then the shifting base 232 of the Z-axis moving module 23 rises to make the lead shield 41 and the syringe 42 to detach from the syringe holder 4. The X-axis moving module 21 and the axis moving module 22 drive the syringe 42 to shift under the lead box 51 for the bottle holder 5. In the process of shifting, the rotation module 24 drives the syringe 42 to rotate in 180 degrees and make the needle of the syringe 42 upward. Now the shifting base 232 of the Z-axis moving module 23 rises again to make the syringe 42 needle to insert into the drug bottle. Then the driving rod 32 for the syringe driving mechanism 3 drives the moving device 33 and the clamping slot 34 drives the drug-withdrawing rod of the syringe 42 to withdraw radiopharmaceuticals from the bottle.

When the syringe 42 completes the drug-withdrawing process, the shifting base 232 of the Z-axis moving module 23 descends to make the syringe 42 needle to detach from the drug bottle. Then X-axis moving module 21 and Y-axis moving module 22 drive the syringe 42 to shift above the syringe holder 4. In the process of shifting, the rotation module 24 drives the syringe 42 to rotate in 180 degrees and makes the syringe 42 needles downward. Then the shifting base 232 of the Z-axis moving module 23 descends to position the syringe 42 into the syringe holder 4 and the needle extends into the cylinder to complete the drug dispensing process. By repeating the above process, other syringes 42 on the syringe holder 4 continue to proceed with drug-withdrawing.

In summary, the automated dispenser for radiopharmaceuticals in the invention can prevent operators from contacting radiopharmaceuticals and reduce exposure to radiation. The invention is an innovative and advanced achievement. The patent application is thus submitted. The above content is only an explanation for a preferred embodiment for the invention. Those changes, modification, alteration or equivalent replacements based on the technical approach and extension of the scope of the invention shall fall into the claims of the patent application.

Figure 1:
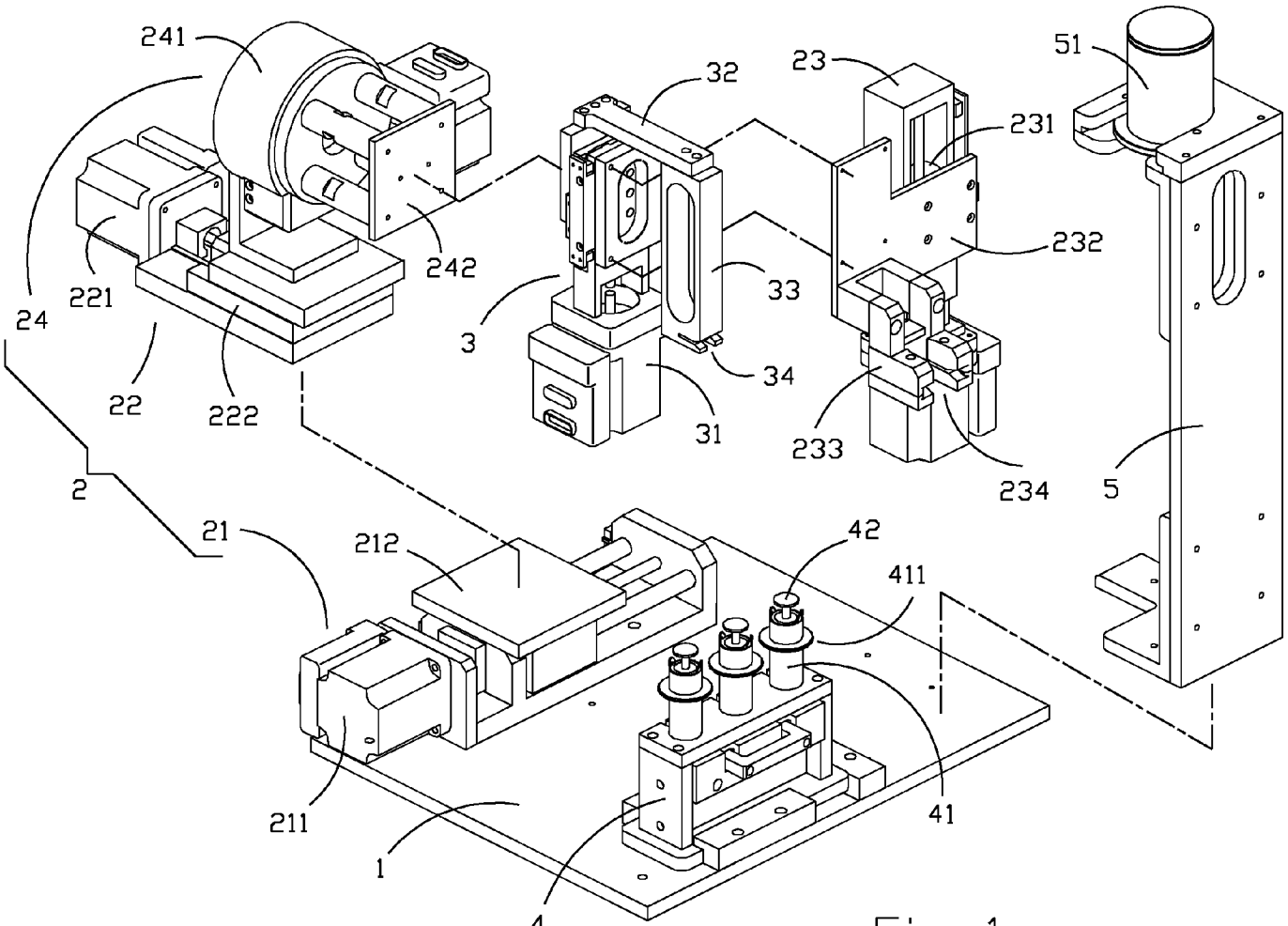
FIG. 1 is a structural disassembly diagram for the invention.
Figure 2:
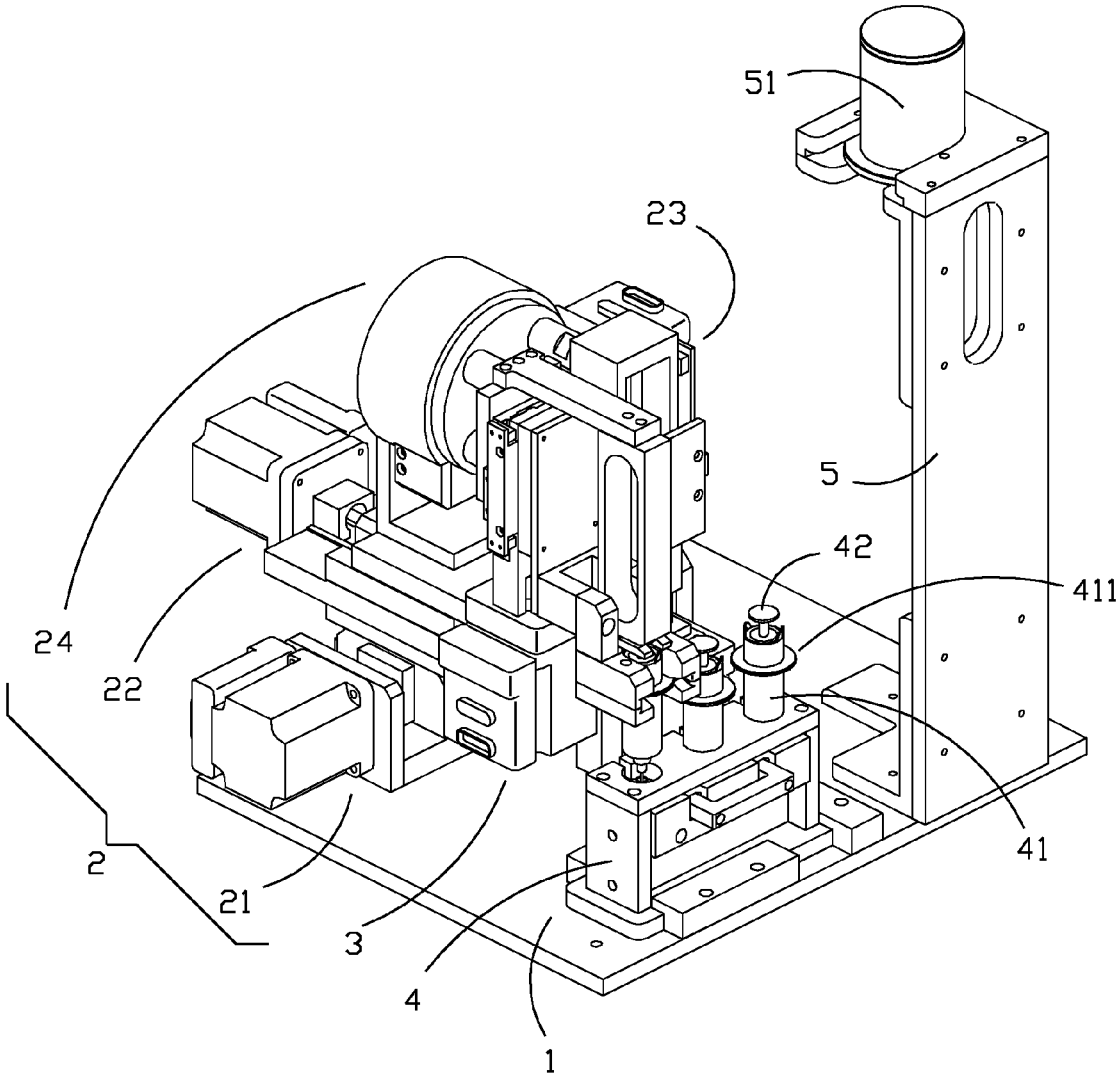
FIG. 2 is the assembly diagram and the operation diagram (1) for the invention.
Figure 3:
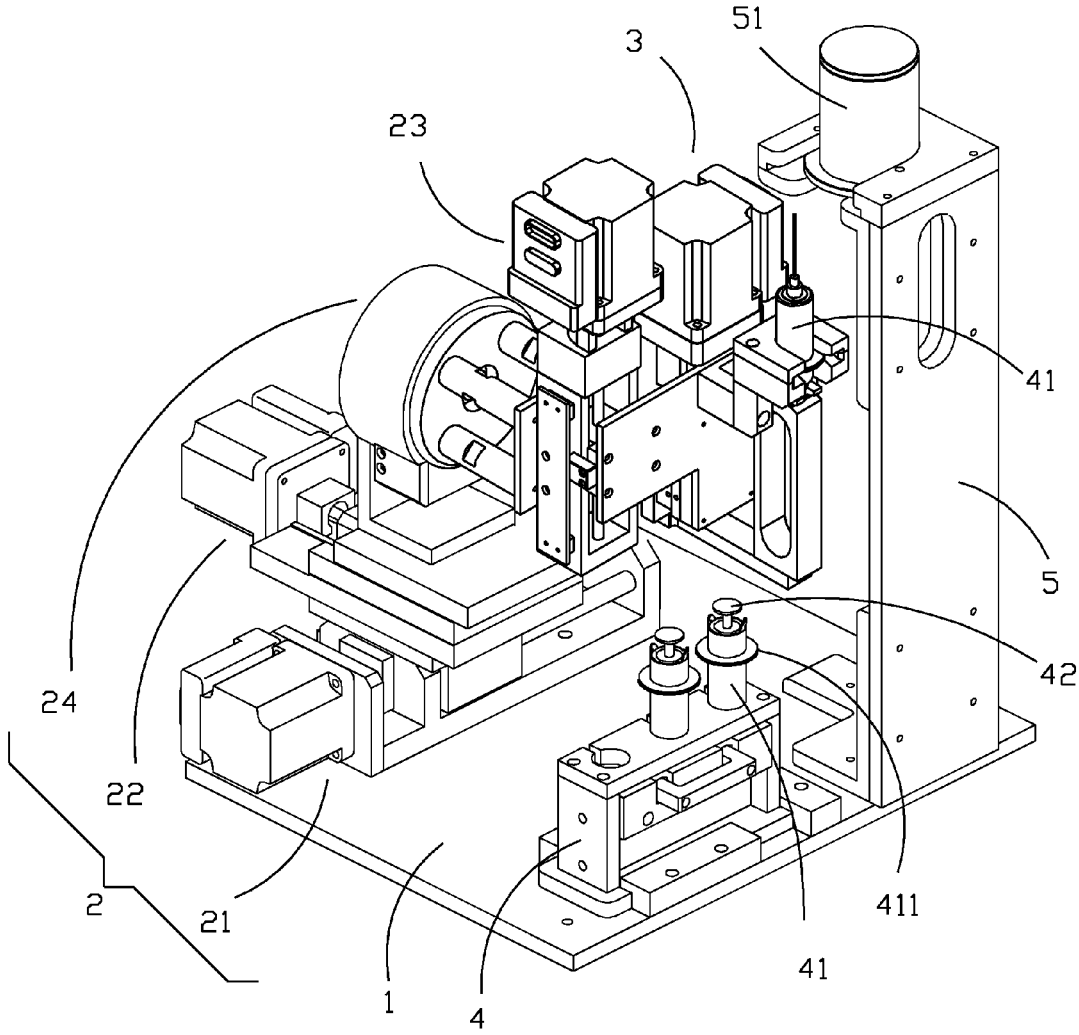
FIG. 3 is the operation diagram (2) for the invention.

What is claimed is:

1. An automated dispenser for radiopharmaceuticals comprising:

a platform (1) having a supporting plane furnished on top;

a drug bottle located at one side of the platform;

a moving mechanism (2), characterized in that the moving mechanism (2) is at least composed of an X-axis moving module (21), a Y-axis moving module (22) and a Z-axis moving module (23), being equipped on the platform to drive a syringe clamp (233) to hold a syringe (42) and move it in the three dimensional space back and forth, and further including a rotational module furnished on top of a shifting platform (222) for turning the syringe clamp (233) around an axis in horizontal direction, shifting the syringe from an external position to where a needle is inserted into the bottle; and a syringe driving mechanism (3), adapted to move simultaneously with the syringe clamp (233) driven by the moving mechanism (23) and which has a driving rod (32) on it to make the syringe to withdraw drug.

2. An automated dispenser for radiopharmaceuticals as described in claim 1, the syringe clamp (233) is driven by the Z-axis moving module (23) to ascend or descend along the perpendicular Z-axis direction, the Z-axis moving module (23) is driven by the Y-axis moving module (22) to slide back and forth in the Y-axis direction in a preset plane, and the Y-axis moving module (22) is driven by the X-axis moving module (21) to slide back and forth in the X-axis direction in the plane.

3. An automated dispenser for radiopharmaceuticals as described in claim 2, characterized in that the syringe clamp (233) is associated with the Z-axis moving module (23), and through a rotation module (24) drives the rotation of syringe clamp (233) around the Z-axis moving module (23).

4. An automated dispenser for radiopharmaceuticals, as described in claim 1, characterized in that a syringe holder is beside the moving mechanism for the platform for holding syringes.

5. An automated dispenser for radiopharmaceuticals as described in claim 1, characterized in that the syringe is located in a lead shield (41), which periphery has a flange (411) in its middle section, the syringe clamp (233) has a groove corresponding to the flange (411) position, through the shifting of the groove against the flange back and forth, engagement or disengagement can be achieved.

6. An automated dispenser for radiopharmaceuticals as described in claim 4, characterized in that the syringe is located in a lead shield (41), which periphery has a flange (411) in its middle section, the syringe clamp has a clamping slot corresponding to the flange (411) position, through the shifting of the clamping slot against the flange (411) back and forth, engagement or disengagement can be achieved.

7. An automated dispenser for radiopharmaceuticals as described in claim 1, characterized in that the drug bottle is on a bottle holder (5) with its mouth downward.

8. An automated dispenser for radiopharmaceuticals as described in claim 7, characterized in that the drug bottle is located inside a lead box (51).

* * * * *